United States Patent [19]

Arand et al.

[11] Patent Number: 4,474,591

[45] Date of Patent: Oct. 2, 1984

[54] PROCESSING PRODUCED FLUIDS OF HIGH PRESSURE GAS CONDENSATE RESERVOIRS

[75] Inventors: Dale P. Arand, Aurora, Colo.; Robert H. Wilson, Spring, Tex.

[73] Assignee: Standard Oil Company (Indiana), Chicago, Ill.

[21] Appl. No.: 516,159

[22] Filed: Jul. 21, 1983

[51] Int. Cl.[3] ..... F25J 3/02

[52] U.S. Cl. ..... 62/31; 62/33; 62/34

[58] Field of Search ..... 62/23, 24, 27, 28, 31, 62/33, 34, 25, 26, 29, 30, 9, 11

[56] References Cited

U.S. PATENT DOCUMENTS 4,203,742 5/1980 Agnihotri ..... 62/24

*Primary Examiner*—Frank Sever

[57] ABSTRACT

A production facility utilizes a first high pressure separation zone, a second intermediate pressure separation zone, a first distillation zone, and a second distillation zone, where the vapor fraction from the second intermediate pressure separation zone and the overhead stream from the first distillation column are recompressed to about the first high pressure. Such a process can produce specification residue gas streams, natural gas liquid streams, and a stabilized condensate stream.

9 Claims, 2 Drawing Figures

PROCESSING PRODUCED FLUIDS OF HIGH PRESSURE GAS CONDENSATE RESERVOIRS

FIELD OF THE INVENTION

The invention relates to processing produced fluids of high pressure gas condensate reservoirs to produce a residue gas stream at pipeline pressure, a natural gas liquid (NGL) stream, and a stabilized condensate stream. In one particular aspect, the invention relates to such a process utilizing a first high pressure separation zone, a second intermediate pressure separation zone, and a distillation zone.

BACKGROUND OF THE INVENTION

Natural gas comprises different hydrocarbons in varying amounts, plus varying amounts of nitrogen, carbon dioxide, and sometimes hydrogen sulfide. If the percentage of condensable hydrocarbons, that is, those that can ordinarily be collected and stored in liquid form, for example, ethane, propane, butane, and the like, is low, then the gas is called "dry" gas. On the other hand, if there is present in this natural gas a sufficient amount of the condensable hydrocarbons as to make their recovery economically feasible, then the gas is called "wet" gas.

In the case of a typical "wet" gas, a production facility can effect a separation of produced fluids into a residue gas stream containing predominantly methane and some $C_2$ through $C_8$ hydrocarbons, for example, and a condensate stream containing predominantly heavier hydrocarbons, for example, $C_5$ and heavier hydrocarbons. If there are sufficient $C_2$ through $C_8$ hydrocarbons in the residue gas stream to economically justify natural gas liquids recovery, then the residue gas stream from the production facility can be further processed downstream in a natural gas processing plant for natural gas liquids recovery. Thus, in the case of a typical "wet" gas, recovery of natural gas liquids will or will not be desirable, depending upon whether or not there are sufficient natural gas liquids available in the residue gas stream to economically justify the construction and operation of a natural gas processing plant downstream of the production facility.

The processing of fluids from a gas-condensate well, however, presents a different set of considerations. A gas-condensate field is one in which the hydrocarbons exist in a vapor state under high pressure. When this vapor comes to the surface and the pressure is reduced, almost all of the condensable hydrocarbons may be transformed into a liquid which may include small amounts of methane and ethane, while almost all of the methane and ethane and some of the condensable hydrocarbons remain as a gas. The condensate contains, as well as natural gasoline (that is, butanes plus pentanes, hexanes, heptanes, and some octane) and lighter hydrocarbons (for example, $C_2$–$C_4$ hydrocarbons), some heavier hydrocarbons in the $C_9$–$C_{25}$ range or even higher, such as, for example, naphtha, kerosene, mineral seal, or absorption oil and fuel oil. In this case, surface facilities would be mandatory to meet sales product specifications either production facilities or downstream natural gas processing facilities for each of the possible products, such as, for example, gas sales, natural gas liquids sales, and condensate sales. The controlling specifications would be (1) for gas sales—hydrocarbon dewpoint; (2) for condensate sales—Reid Vapor Pressure and flow rate; and (3) for natural gas liquids sales—flow rate, methane content, carbon dioxide content, and ASTM endpoint. The desired goal of such surface facilities would be to meet product specifications with minimal energy requirements and with minimal losses.

In the case of produced fluids from high pressure gas condensate wells, moreover, some form of hydrocarbon recovery at a production facility, as distinguished from a downstream natural gas processing plant for NGL recovery, is mandatory since the natural gas cannot be sold unless these heavier hydrocarbon components which could condense and cause problems in normal operation of the pipeline from the production facility are removed. The cost of this recovery is an additional cost of producing and selling the natural gas. These heavier hydrocarbons have been partially scrubbed out in conventional production facilities and sold as natural gas liquids without meeting natural gas liquids specifications, resulting in a monetary penalization, or have been sent to a downstream natural gas liquids processing unit to achieve specification natural gas liquids.

In many situations where high pressure gas condensate reservoirs are produced only two salable products have been recovered, that is, gas and condensate. In such situations, disposal of the intermediate hydrocarbons which would be important constituents of the natural gas liquids (primarily propane and butane, but also including ethane and higher hydrocarbons) can be a problem. If these hydrocarbons were to be added to the condensate, the condensate product may not meet its vapor pressure specification. If the hydrocarbons were to be left in the gas stream, the hydrocarbon dewpoint specification of the residue gas stream may be in jeopardy.

One type of conventional production facility which can be used to process a wellhead stream produced from a high pressure gas condensate reservoir, known as a central tank battery (CTB), involves flashing down the high pressure gas condensate produced stream to remove the condensate and separate a residue gas which meets hydrocarbon dewpoint specification. In such a facility, the full produced fluid stream can enter high pressure separators for an initial stage of separation usually operated at about 600–1000 psi and 10°–20° F. above the hydrate temperature. The resulting condensate can then be flashed to an intermediate pressure separator operating at about 50 to about 300 psi. The gas from the intermediate pressure separator can then be compressed and recombined with the high pressure separator gas. The intermediate pressure condensate can then be flashed and heated in a low pressure separator or heater treater to about 20–50 psi and 110°–125° F. The resulting condensate can then be flashed to atmospheric pressure for storage in tanks. A vapor recovery unit can compress the gas from the storage tanks and combine this gas with gas from the heater treaters. The resulting combined gas can then be compressed and mixed with the gas from the intermediate separator. The heater treater of such a central tank battery (CTB) is utilized to drive off light ends to meet the condensate product vapor pressure specification and to make water separation easier. A condensate which contains significant amounts of intermediate hydrocarbon components will have a relatively high horsepower requirement. The horsepower requirements can be very large because recycle streams in such a central tank battery (CTB) facility can build up as offgas from the intermediate separators and heater treaters are recompressed to pipeline pressure followed by cooling causing condensation. The condensed liquids returned to the various separators are the source of the recycle. Such central tank battery (CTB) facilities can produce a residue gas meeting hydrocarbon dewpoint specification. The intermediate hydrocarbons can be partially scrubbed out and sold as NGL (natural gas liquids) without meeting specification, but monetarily penalized, or sent to a processing unit to achieve specification NGL.

To reduce the recycle problems of the central tank battery (CTB), a deethanizer can be added to process liquids separated in compressor scrubbers. The addition of the deethanizer allows a specification NGL product to be produced. However, some operational difficulties can be encountered. Choke heaters may be required on high pressure streams flashed to lower pressures in order to prevent hydrate formation. Also, depending on the composition and production pressure levels, gases may have conditions near their critical region during compression and cooling. This can result in erratic levels in the scrubbers operating in this critical region.

With higher energy prices, however, more efficient separation techniques not subject to these problems are in demand for recovery at a production facility of stabilized condensate and specification NGL from natural gas produced from high pressure gas condensate reservoirs. As can be appreciated from the above description, conventional processes such as central tank battery (CTB) facilities can require a large amount of compression and are therefore inefficient. Similarly, as indicated, there are a number of potential problems in utilizing the central tank battery (CTB) with deethanizer system. A demand therefore exists for a stabilization process that is more efficient than these past processes and which is capable at a production facility of producing specification residue gas and natural gas liquids as well as specification stabilized condensate products. The present invention meets these requirements in an efficient and economical manner and avoids the problems presented by the past processes.

SUMMARY OF THE INVENTION

According to the invention, a produced fluid stream from a high pressure gas condensate reservoir can be processed to produce a residue gas stream meeting hydrocarbon dewpoint specification, a specification natural gas liquids stream, and a stabilized condensate stream. The method employs two distillation towers or columns in series to stabilize and fractionate the produced condensate including significant fractions of both intermediate and heavy hydrocarbons and can increase liquid recovery and reduce energy requirements when compared with conventional production facilities operation. For example, less than about 50% of the energy used in certain conventional production facilities operations may be required by the invented process per barrel of liquids recovered.

The invention process has the flexibility for maximizing either the condensate product or the natural gas liquids product by simply altering the operation of the same separation step or by adding minimal additional equipment. With this built-in flexibility, the plants can be switched to produce more of one product stream or another (for example, more of natural gas liquids and less of condensate, or vice versa) to accommodate changing product prices or changes in transport availability in the different pipelines.

Thus, according to the invention, there is provided a method for processing a produced fluid stream including significant fractions of both intermediate and heavy hydrocarbons from a high pressure gas condensate reservoir to produce a residue gas stream comprising predominantly methane, a natural gas liquids stream, and a stabilized condensate stream. The invented process also has the flexibility and capability of including ethane and/or propane in the residue gas stream if desired to increase heating value. The invention comprises introducing a produced fluid stream from high pressure gas condensate reservoirs into a first separator zone operated at about a first pressure and separating the produced fluid stream into a first liquid fraction and a first vapor fraction. The first pressure at which the first separator zone is operated is about the desired pipeline pressure for the residue gas stream. The first liquid fraction is withdrawn from the first separator zone and introduced into a second separator zone to separate the first liquid fraction into second vapor fraction and a second liquid fraction. The second separator zone is preferably operated at a lower pressure of operation than the first separator zone and at a higher pressure than the first distillation zone to follow. The lower pressure of operation of the second separator zone is such that the second vapor fraction is compressible by a single stage of compression to about the first pressure.

The second liquid fraction from the second separator zone is withdrawn and introduced as feed, for example, by flashing, into a first distillation column comprising a plurality of vapor liquid contact devices. The first distillation column is operated under conditions effective to produce a first overhead stream enriched in methane or in methane plus ethane and a first bottoms product stream enriched heavier components of the second liquid fraction. The first distillation column is operated at a pressure such that the first overhead stream is produced at a pressure such that only a single stage of recompression is necessary to return the first overhead stream to about the first pressure.

A stream is removed from adjacent the bottom of the first distillation column, a pressure differential is introduced into the stream, for example, by a pump or the like, and the stream is circulated by forced circulation through a first bottoms reboiler to maintain an effective operating temperature in the first distillation column, the reboiled fluid being reintroduced adjacent the bottom of the first distillation column to maintain effective operating temperatures in the first distillation column.

The first bottoms product stream is withdrawn from adjacent the bottom of the first distillation column and is introduced as feed into a second distillation column containing a plurality of vapor liquid contact devices and operated under conditions to produce a second overhead stream enriched in natural gas liquid (for example, $C_2$–$C_6$ or $C_2$–$C_8$, or the like) components of the first bottoms product stream and a second bottoms stream enriched in heavier components of the first bottom stream (for example, $C_7$ or $C_9$ and heavier). The second column split can be set to maximize either natural gas liquids or condensate production. A stream is withdrawn from adjacent the bottom of the second distillation column, a pressure differential is introduced into the second stream, and the stream is circulated by forced circulation through a second reboiler back to the second distillation column adjacent the bottom thereof to maintain effective operating temperatures in the second distillation column.

The second vapor fraction and the first overhead stream from the first distillation column are then recompressed by a single stage of compression to about the first pressure and are combined with the first vapor fraction from the first separator zone. In one aspect, the second vapor fraction and the first overhead stream from the first distillation column can be combined prior to such recompression.

The invention will be better understood and other applications of the invented process in accordance with the spirit of the invention will be apparent to those skilled in produced fluids processing from the following detailed description and the drawings in which.

DETAILED DESCRIPTION OF THE INVENTION

Figure 1:
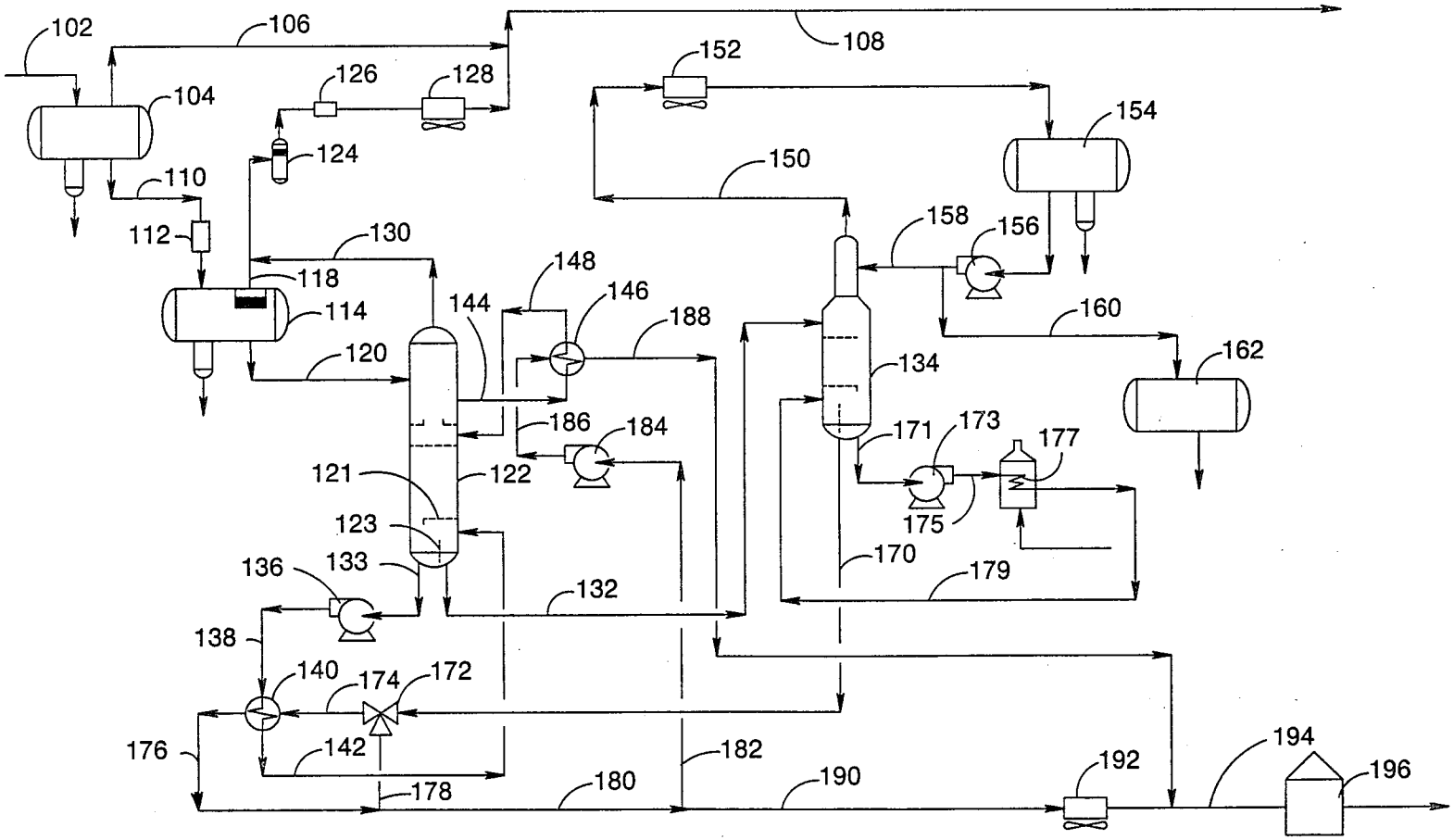
FIG. 1 represents a first embodiment of the invention.

The invented process recovers hydrocarbons at a production facility from a produced fluid stream from high pressure gas condensate reservoirs. Such high pressure gas condensate reservoirs typically have a pressure in excess of about 600 psia, and may range to as high as 3000 psia or even higher. The produced fluid comprises methane and ethane, and can be highly saturated with hydrocarbons heavier than methane and ethane including, for example, intermediate hydrocarbons including, for example, propane, butane, pentane, hexanes, and heavier hydrocarbons as heavy as $C_{40}$ and the like. The natural gas liquids fraction comprising $C_2$ through as high as, for example, $C_8$ components can comprise more than about 3 mol %, commonly in the range of about 3 to about 15 mol % or higher. The $C_9$ and heavier components can comprise more than about 1 mol %, commonly in the range of about 1 to about 15 mol % or higher of the total hydrocarbons in the produced fluids from such reservoirs. Even lower or higher percentages of natural gas liquids and condensate can be present in the produced fluid stream. However, it is expected that the benefits of the invention will be best realized if the produced fluid stream contains in addition to sales quantities of natural gas, a ratio of natural gas liquids ($C_3$–$C_8$) to heavy condensate ($C_9$ and higher) of 0.5 or higher and preferably about 1 or higher. As used herein, the term "natural gas liquids components" will be used to refer to any or all of $C_2$ through about $C_8$ hydrocarbons or higher which are included in natural gas liquids streams. As used herein, the term "heavy condensate" or "heavy condensate fraction" will be used to refer to the $C_9$ and heavier components present in produced fluids from high pressure gas condensate wells.

According to the invention, such a produced fluid stream, after pressure reduction if necessary to about pipeline pressure, is introduced into a first separation zone operated at a first pressure, the first pressure being about pipeline pressure for the residue gas stream, and is separated into a first liquid fraction and a first vapor fraction. The first vapor fraction is withdrawn from the first separation zone at about the first pressure, and comprises predominantly methane, although some ethane and heavier equilibrium hydrocarbons may be present. Removal of the heavier equilibrium hydrocarbons, for example, by scrubbing or by filtering or the like may be desirable before further processing of the residue gas stream, for example, by amine treatment or the like.

The first separator zone can preferably be operated at a first pressure which is about pipeline pressure and which is selected to maximize removal of hydrocarbon liquids from the produced fluid stream which is defined by the equilibrium curve of the produced fluid and can be optimized for each reservoir. Broadly, the first pressure can range from about 300 psia or even lower to about 1200 psia or higher. It is contemplated that the greatest benefit from utilizing the process of the instant invention will be realized in conjunction with processing produced fluids from high pressure, gas condensate wells because the instant process greatly reduces recompression requirements and energy requirements as compared with conventional processes for treating such fluids while permitting recovery of specification natural gas liquids product and stabilized condensate product streams. Preferably, the first separator zone can be operated in the range of about 600 psia to about 1200 psia.

The first liquid fraction, containing the heavy condensate fraction, produced in the first separator zone can be withdrawn and introduced into a second separator zone which is operated at a lower pressure of operation than the first separator zone. The lower pressure of operation is selected such that the second vapor fraction produced by the separation in the second separator zone is compressible by a single stage of compression to about the first pressure. Thus, the lower operating pressure can be about $\frac{1}{3}$ of the pressure at which the first (high) pressure separator is operated, and broadly in the range of about 200 psia to about 600 psia so as to minimize recompression requirements and to maximize condensate recoveries from the second separator zone. The second liquid fraction, containing natural gas liquids components and the heavy condensate fraction, produced by separation in the second separator zone can be withdrawn and introduced as feed into a first distillation column.

The first distillation column is operated as a demethanizer and typically utilizes operating pressures in the range of about 100 to about 450 psia or even higher. Above about 450 psia, problems can be encountered in taking light components of the second liquid fraction overhead from the column; and below about 100 psia, the addition of feed chilling or overhead reflux condensation to prevent loss of natural gas liquids in the overhead may be necessary. The operating temperatures of the column could be as low as about 0° F. at about 100 psia to about 400° F. at 450 psia and is generally a function of the operating pressure of the system. Generally, the demethanizer column is operated so that the approach to the hydrate point is no closer than 10° F.; although, of course, closer operation to the hydrate point can be effected by addition of appropriate hydrate formation inhibitors such as, for example, methanol and the like.

Bottom tray liquid, diluted with a portion of the first bottoms product, can be withdrawn from adjacent the bottom of the first distillation column and circulated by forced circulation, for example, by a pump, through a first reboiler, and the heated reboiler stream returned, for example, by flashing to the bottom of the first distillation column to maintain an effective operating temperature. By diluting the bottom tray liquid with the first bottoms product, problems in heat transfer which can be encountered in operating the first column to meet, for example, methane and carbon dioxide specifications with recovery of ethane when, as here, the feed to the first column contains components with a wide range of volatilities ranging from methane to the heavy condensate fraction can be minimized or eliminated. For example, with a feed such as the second liquid fraction, which can comprise in the range of $C_1$ and $C_2$ through as high as $C_{40}$ or higher hydrocarbons, the boiling point range of the fluid passed through the first bottoms reboiler can be in excess of 500° F. which can cause severe problems in heat transfer in the bottoms reboiler such as, for example, film boiling and/or annular mist flow. By forced circulation of a stream comprising bottom tray liquid diluted with first bottoms product through a first bottoms reboiler, the percentage of vaporization can be reduced and more turbulent flow achieved to reduce these problems in heat transfer while maintaining the first column at an effective operating temperature.

According to one aspect of the invention, the first bottoms reboiler is an indirect heat exchanger and the heat exchanger medium utilized is the second bottoms product stream from the second distillation column hereinafter described. This second bottoms product stream can also be used as heat exchange medium in an indirect heat exchange side reboiler in conjunction with the first distillation column. In such utilization, the temperature difference between the cooled second bottoms stream withdrawn from the first bottoms reboiler after heat exchange therein can be so large as to cause heat transfer problems such as film boiling in the side reboiler. However, by use of a pump-around on the side reboiler to recirculate cooler fluid from the exit of the side reboiler to the inlet, the inlet temperature of the heat exchange medium to the side reboiler can be controlled. The temperature differential is thereby reduced, and the film boiling problem can be eliminated. In another aspect of the invention, the first bottom reboiler can be a direct fired reboiler.

The first overhead stream from the first distillation column can be recompressed by a single stage of compression to about the first pressure; similarly, the second vapor fraction stream from the second separator zone can be recompressed by a single stage of compression. Preferably, the second vapor fraction stream and the first overhead stream are combined and the resulting combined stream provided to a single stage of compression to be brought back up to about the first (pipeline) pressure.

The first bottoms product stream, containing natural gas liquids components and a heavy condensate fraction, from the first distillation column is provided as feed to the second distillation column. In the second distillation column, changes in the mode of operation can determine whether natural gas liquids production or condensate production is maximized. Preferably, the second distillation column is operated at a pressure in the range of about 50 to about 400 psia with at least about a 50 psia differential from the operating pressure of the first column to enable flow from the first column to the second column without additional pumping requirements. Of course, even higher pressure operations can be utilized with addition of pumps if desired. The pressure is also determined by the compression of the overhead and is preferably chosen to enable total condensation of the overhead natural gas liquids in an air cooler. Even lower pressures could be utilized if additional refrigeration were utilized. Thus, as indicated, the operating pressure of the second distillation column generally is in the range of about 50 to about 400 psia. The operating temperatures of the second distillation column are preferably below the coking temperature of the reboiler stream which of course contains a heavy condensate fraction in a direct-fired reboiler which can be utilized as herein described to maintain the operating temperature of the second distillation column. Thus, the bottom temperature of the second distillation column is preferably less than about 550° F. and the operating temperature is effective for taking overhead the desired overhead product. For example, if maximization of NGL (overhead) product is required, higher operating temperature and/or lower pressure can be utilized than is appropriate when maximization of condensate product is desired.

When maximization of natural gas liquids production is elected, the overhead stream from the second distillation column can be of much greater quantity than when condensate maximization is elected. In either instance, heat can be recovered from the second bottoms stream and/or the second overhead stream. and returned to the process to conserve on energy requirements. In one aspect of the invention, the second bottoms product stream from the second distillation column can be provided as heat exchange medium to the first bottoms reboiler for the first distillation column. According to another aspect of the invention, the second bottoms product can be utilized to provide heat to the first bottoms product stream prior to introduction as feed to the second distillation column. According to this aspect, both the first and second reboilers can be direct-fired reboilers. In a further aspect of the invention, the second overhead stream from the second distillation column can be utilized to provide heat by indirect heat exchange by a side reboiler to the first distillation column. Two side reboilers can be utilized to facilitate the separation of carbon dioxide and ethane.

By utilizing a process in accordance with the invention at a production facility, two liquid products (natural gas liquids and stabilized condensate) meeting product specifications and a residue gas stream more efficiently meeting pipeline specifications can be produced with a very substantial reduction in the compression requirements as compared with conventional production facilities. In addition, by utilizing in accordance with the invention a demethanizer column prior to a stabilizer column, hydrate formation and critical phase problems which can be encountered in a central tank battery with deethanizer can be eliminated.

Additional changes and modifications will be apparent to those skilled in the operation and design of production facilities from the following detailed description and the drawings.

DETAILED DESCRIPTION OF THE DRAWINGS

Referring now to the drawings and in particular to FIG. 1, FIG. 1 represents a first embodiment of the invention in which stablized condensate production is maximized. Referring now to FIG. 1 in detail, a produced fluid stream from a high pressure gas condensate reservoir is introduced by line 102 into first separator zone 104 operating at a pressure near the residue gas pipeline pressure, for example, in the range of about 600 psia to about 1200 psia. The first separator 104 separates the produced fluid stream into a first vapor fraction which can be removed by line 106 as a portion of the residue gas pipeline stream 108 at about the first pressure.

The first liquid fraction from separator 104 can be removed by line 110 to mixer 112 and introduced by flashing into a second separator zone 114. The second separator zone effects a separation of the first liquid fraction into a second vapor fraction and a second liquid fraction and is designed to provide a stable flow of hydrocarbon liquids constituting the second liquid fraction to the first distillation column 122. The second separation zone is operated at a lower pressure than that of the first separation zone such that only a single stage of recompression is required to bring the pressure of the second vapor fraction up to residue gas pipeline pressure.

A water wash system can be used in the second separation zone 114 to remove brine from the processed fluid and thereby reduce salt concentration of the second liquid fraction which is provided as feed to the first distillation column 122. The second vapor fraction can be removed from the second separation zone by line 118, scrubbed in residue gas compressor scrubber 124, and recompressed to residue gas stream pipeline pressure (about first pressure) by compressor 126 to provide a portion of the residue gas product stream 108 after cooling, for example, in residue gas cooler 128. The second liquid fraction from the second separation zone 114 can be removed by line 120 and flashed as feed into the first distillation column, for example, adjacent the top thereof. The first distillation column 122 is operated under conditions of temperature and pressure and feed rate to produce a first overhead stream comprising predominantly methane which can be removed by line 130. Some ethane and/or propane, depending upon the selected operating conditions, may also be present. The first overhead stream can then be combined with the second vapor stream 118 and the combined streams recompressed to residue gas pipeline pressure (first pressure). Although the first column 122 is illustrated without a reflux condenser, it will be appreciated that in the case of a hot produced fluids stream entering the first separation zone, addition of a refluxed condenser in the overhead of the first distillation column 122 may result in higher recovery levels of condensate and natural gas liquids.

The first bottoms fraction comprising predominantly ethane, especially propane and heavier hydrocarbons, can be removed by line 132 from the bottom of the first distillation column 122 and provided as feed to the second distillation column 134.

Distillation column 122 can be provided below the bottom tray 121 with a vertical weir 123 so as to effect dilution of bottom tray liquid with first bottoms product. As illustrated in FIG. 1, a stream comprising a portion of the bottoms tray liquid, diluted with the first bottoms product, can be removed by line 133, pump 136, and line 138 and brought into indirect heat exchange in first bottoms reboiler 140 with the second bottoms product stream from the second distillation column 134 via line 170, valve 172, and line 174. The reboiled fluid can be returned to the bottom of the first distillation column by line 142 and flashed into the column adjacent the bottom thereof below bottom tray 121 and on the bottoms product side of vertical weir 123. The cooled second bottoms stream can be withdrawn from the first bottoms reboiler 140 by line 176 and a portion bypassed by line 178 to control operating temperature. The first cooled second bottoms stream can also be taken by line 180, line 182, pump 184, and line 186 to a side reboiler 146 where it can be utilized to provide additional heat by indirect heat exchange with intermediate tray liquid withdrawn from the first distillation column 122, for example, by line 144, and returned by line 148. The first cooled second bottom stream is thereby cooled to produce a second cooled second bottom stream which can be returned by line 188 to be recombined with the remaining portion of the fluid in line 180 via line 190 and condensate product storage cooler 192 after removal by line 182, to produce a stabilized condensate stream which can be taken, for example, by line 194 to condensate storage 196.

The first bottoms product can be removed from the first distillation column 122 by line 132 and introduced as feed into the second distillation column 134 adjacent an intermediate portion thereof. Second column 134 is operated under conditions of temperature, pressure, and feed rate to maximize stabilized condensate production. A second overhead stream comprising a specification natural gas liquids product can then be removed by line 150 and air-cooled by second distillation column overhead condenser 152 to condense fluids therefrom which can be accumulated in reflux accumulator 154 and returned to the top of the second distillation column by reflux pump 156 and line 158. Natural gas liquids product can be removed by line 160 to natural gas liquids product storage tank 162.

As in first column 122, a portion of the bottom tray liquid and the second bottoms product stream from the second distillation column 134 can be withdrawn from the second distillation column by line 171, the pressure increased, for example, by pump 173, and provided to a direct-fired second bottoms reboiler 177 by line 175. The thus withdrawn portions are heated to a temperature below that causing coking of the heavy condensate second bottoms product stream, that is, below about 550° F., and returned by line 179 to adjacent the bottom of the second distillation column 134.

To further illustrate the embodiment of FIG. 1, the following simulated example of the embodiment of FIG. 1 is provided:

EXAMPLE 1

The embodiment of FIG. 1 is simulated having the following temperatures, pressures, flow rates and conditions. Numbers enclosed in parentheses are for reference to FIG. 1.

TABLE IA

| Component | Inlet (102) | First Vapor (106) | First Liquid (110) | Second Vapor (118) | Second Liquid (120) | Residue Gas (108) |
|---|---|---|---|---|---|---|
| Carbon Dioxide | 47.65 | 36.80 | 10.85 | 3.85 | 7.00 | 46.74 |
| Nitrogen | 162.64 | 151.89 | 10.75 | 7.88 | 2.87 | 162.64 |
| Methane | 6225.78 | 5367.40 | 858.38 | 450.45 | 407.93 | 6225.73 |
| Ethane | 1248.22 | 779.79 | 468.43 | 92.16 | 376.27 | 966.43 |
| Propane | 692.97 | 271.27 | 421.70 | 31.96 | 389.74 | 335.08 |
| n-Butane | 229.95 | 46.40 | 183.55 | 4.99 | 178.56 | 56.26 |
| i-Butane | 163.65 | 41.13 | 122.52 | 4.52 | 118.00 | 50.09 |

TABLE IA-continued

| Component | Inlet (102) | First Vapor (106) | First Liquid (110) | Second Vapor (118) | Second Liquid (120) | Residue Gas (108) |
|---|---|---|---|---|---|---|
| n-Pentane | 87.02 | 8.31 | 78.71 | 0.79 | 77.92 | 9.86 |
| i-Pentane | 89.08 | 10.34 | 78.74 | 1.01 | 77.73 | 12.32 |
| n-Hexane | 146.05 | 6.13 | 139.92 | 0.51 | 139.41 | 7.12 |
| $C_7$ | 200.95 | 3.97 | 196.98 | 0.30 | 196.68 | 4.54 |
| $C_8$ | 306.59 | 2.59 | 304.00 | 0.17 | 303.83 | 2.91 |
| $C_9$ | 177.12 | 0.64 | 176.48 | 0.04 | 176.44 | 0.71 |
| $C_{10}$ | 107.72 | 0.18 | 107.54 | 0.01 | 107.53 | 0.20 |
| $C_{11}$-$C_{15}$ | 242.36 | 0.05 | 242.31 | 0.00 | 242.31 | 0.05 |
| $C_{16}$+ | 230.98 | 0.00 | 230.98 | 0.00 | 230.98 | 0.00 |
| Mols/Hr | 10358.73 | 6726.89 | 3631.84 | 598.64 | 3033.20 | 7880.68 |
| Temp. (°F.) | 85 | 85 | 85 | 82 | 82 | 90 |
| Pressure (psia) | 911.1 | 911.1 | 911.1 | 511.1 | 511.1 | 911.1 |

TABLE IB

| Component | First Overhead (130) | First Bottoms (132) | Second Overhead (150) | Second Bottoms (171) | NGL (160) |
|---|---|---|---|---|---|
| Carbon Dioxide | 6.09 | 0.91 | 1.36 | 0.00 | 0.91 |
| Nitrogen | 2.87 | 0.00 | 0.00 | 0.00 | 0.00 |
| Methane | 407.88 | 0.05 | 0.03 | 0.00 | 0.05 |
| Ethane | 94.48 | 281.79 | 422.37 | 0.19 | 281.60 |
| Propane | 31.85 | 357.89 | 482.17 | 36.42 | 321.47 |
| i-Butane | 4.44 | 113.56 | 98.86 | 47.65 | 65.91 |
| n-Butane | 4.87 | 173.69 | 127.24 | 88.89 | .84.80 |
| i-Pentane | 0.97 | 76.76 | 35.34 | 53.20 | 23.56 |
| n-Pentane | 0.76 | 77.16 | 31.79 | 55.76 | 21.20 |
| n-Hexane | 0.48 | 138.93 | 30.11 | 118.85 | 20.08 |
| $C_7$ | 0.27 | 196.41 | 19.64 | 183.31 | 13.10 |
| $C_8$ | 0.15 | 303.68 | 2.17 | 302.23 | 1.45 |
| $C_9$ | 0.03 | 176.41 | 0.01 | 176.40 | 0.01 |
| $C_{10}$ | 0.01 | 107.52 | 0.00 | 107.52 | 0.00 |
| $C_{11}$-$C_{15}$ | 0.00 | 242.31 | 0.00 | 242.31 | 0.00 |
| $C_{16}$+ | 0.00 | 230.98 | 0.00 | 230.98 | 0.00 |
| Mols/Hr | 555.15 | 2478.05 | 1251.09 | 1643.91 | 834.14 |
| Temp. (°F.) | 80.4 | 317.7 | 210 | 530 | 114 |
| Pressure (psia) | 450 | 455 | 355 | 360 | 340 |

1. Column 122 is simulated as having 20 actual trays with stream 120 introduced on the top tray and side reboiled stream 148 returned to tray number 5.
2. Column 134 is simulated as having 25 actual trays with feedstream 132 introduced to tray number 13.

Figure 2:
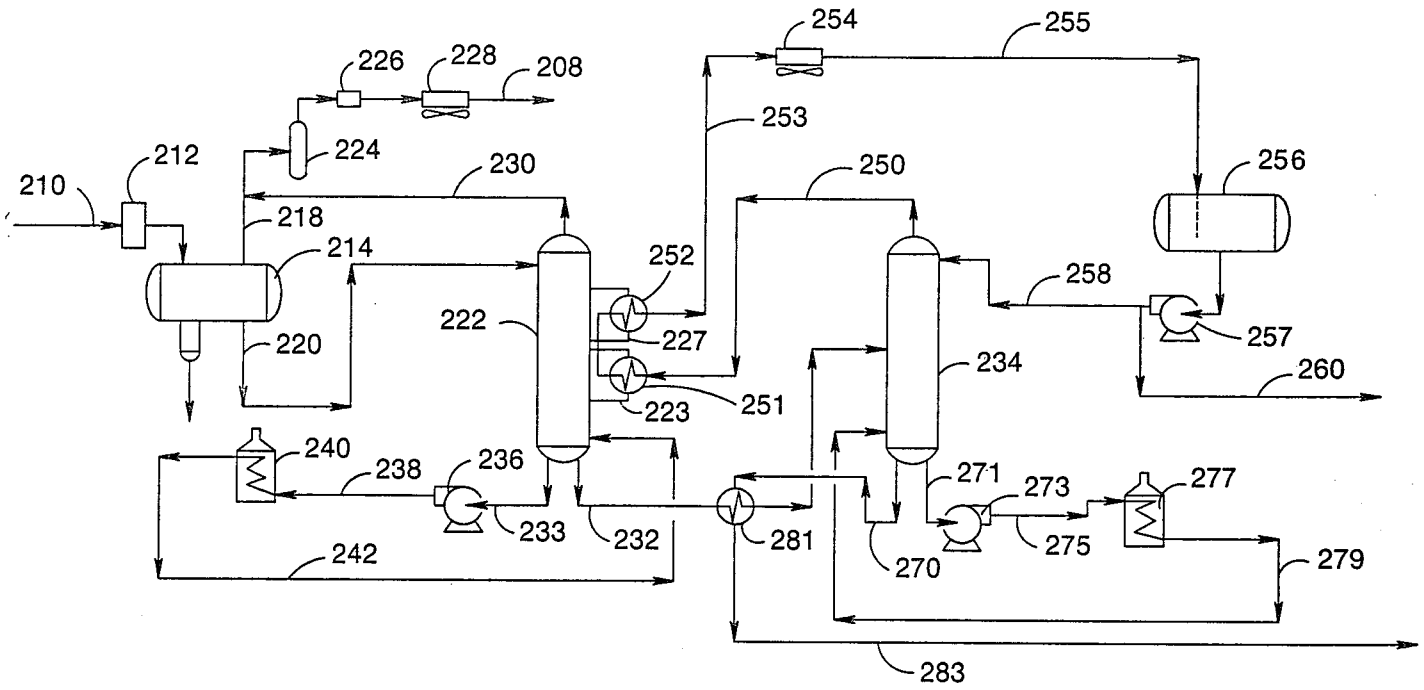
FIG. 2 represents a second embodiment of the invention according to the invention.

Referring now to FIG. 2, FIG. 2 represents a second embodiment of the invention in which the second distillation column can be operated to maximize production of natural gas liquids. Referring now to FIG. 2 in detail, a produced fluid stream from a high pressure gas condensate reservoir after introduction into a first separator zone (not shown in FIG. 2 but such as shown in FIG. 1) operating at a pressure near the residue gas pipeline pressure, for example, in the range of about 600 psia to about 1200 psia, to produce a first vapor fraction and a first liquid fraction, has the first liquid fraction removed therefrom, for example, by line 210 to mixer 212 and introduced by flashing into a second separator zone 214. The second separator zone effects a separation of the first liquid fraction into a second vapor fraction and a second liquid fraction and is designed to provide a stable flow of hydrocarbon liquids constituting the second liquid fraction to the first distillation column 22. The second separation zone is preferably operated at a lower pressure than that of the first separation zone.

A water wash system can be used in the second separation zone 214 to remove brine from the processed fluid and thereby reduce salt concentration of the second liquid fraction which is provided as feed to the first distillation column 222. The second vapor fraction can be removed from the second separation zone by line 218, scrubbed in residue gas compressor scrubber 224 and recompressed to residue gas pipeline pressure (about first pressure) by compressor 226 to provide a portion of the residue gas product stream 208 after cooling, for example, in residue gas cooler 228. The second liquid fraction from the second separation zone 214 can be removed by line 220 and flashed as feed into the first distillation column 222, as illustrated, adjacent the top thereof. The first distillation column 222 is operated under conditions of temperature and pressure and feed rate to produce a first overhead stream comprising predominantly methane or methane and ethane which can be removed by line 230. Some higher hydrocarbons may also be present. The first overhead stream can then be combined with the second vapor stream 218 and the combined streams recompressed to residue gas pipeline pressure (first pressure). The first bottoms fraction comprising ethane, especially propane and heavier hydrocarbons, can be removed by line 232 from the bottom of the first distillation column 222 and provided as feed to the second distillation column 234.

As illustrated in FIG. 2 and described above in reference to FIG. 1, a portion of the bottoms tray liquid, diluted with the first bottoms product, can be removed by line 233, pump 236, and line 238 and heated in direct-fired reboiler 240 to produce a reboiled stream which can be returned to the bottom of the first distillation column by line 242 and flashed into the column adjacent the bottom thereof.

The first bottoms product can be removed from the distillation column 222 by line 232 and introduced as feed into the second distillation column 234 adjacent an intermediate portion thereof. Prior to introduction, the stream in line 232 can be heated by indirect heat exchange in exchanger 281 with second bottoms stream from column 234 by line 270. The cooled second bottoms stream is removed by line 283 and sent to storage or further processing.

The second distillation column is operated under conditions of temperature, pressure, and feed rate to maximize natural gas liquids production. A second overhead stream comprising a specification natural gas liquids product can be removed by line 250 and cooled by passing in indirect heat exchange with intermediate tray liquid removed from first column 222 by lines 223 and 227 in exchangers (side reboilers) 251 and 252, respectively, to produce a cooled overhead stream 253. The overhead stream 253 can then be passed to overhead condenser 254 and line 255 to accumulator 256 and returned to the top of the second distillation column 234 by reflux pump 257 and line 258. Natural gas liquids product can be removed by line 260 to a natural gas liquid storage tank or for further processing.

A portion of the bottom tray liquid diluted with the second bottoms product from the second distillation column 234 can be withdrawn from the second distillation column by line 271, the pressure increased, for example, by pump 273, and provided to a direct-fired reboiler 277 by line 275. The thus withdrawn portions are heated to a temperature below that causing coking of the condensate second bottoms product, that is, below about 550° F., and returned by line 279 to adjacent the bottom of the second distillation column 234.

To further illustrate the embodiment of FIG. 2, the following simulated Example 2 is provided:

EXAMPLE 2

The embodiment of FIG. 2 is simulated having the following temperatures, pressures, flow rates and conditions. Numbers enclosed in parentheses are for reference to FIG. 2.

TABLE IIA

| Component | First Liquid (210) | Second Vapor (218) | Second Liquid (220) | Residue Gas (208) |
|---|---|---|---|---|
| Carbon Dioxide | 6.61 | 1.11 | 5.50 | 6.61 |
| Nitrogen | 0.11 | 0.06 | 0.05 | 0.11 |
| Methane | 107.79 | 32.15 | 75.64 | 107.79 |
| Ethane | 43.96 | 3.41 | 40.55 | 40.03 |
| Propane | 49.33 | 1.27 | 48.06 | 7.58 |
| n-Butane | 28.03 | 0.23 | 27.80 | 1.36 |
| i-Butane | 17.19 | 0.20 | 16.99 | 1.18 |
| n-Pentane | 12.38 | 0.04 | 12.34 | 0.21 |
| i-Pentane | 14.24 | 0.05 | 14.19 | 0.31 |
| n-Hexane | 39.13 | 0.04 | 39.09 | 0.23 |
| $C_7$ | 65.31 | 0.02 | 65.29 | 0.12 |
| $C_8$ | 54.39 | 0.01 | 54.38 | 0.03 |
| $C_9$ | 36.44 | 0 | 36.44 | 0.01 |
| $C_{10}$ | 23.69 | 0 | 23.69 | 0 |
| $C_{11}$ | 15.86 | 0 | 15.86 | 0 |
| $C_{12}$ | 11.93 | 0 | 11.93 | 0 |
| $C_{13}$ | 9.28 | 0 | 9.28 | 0 |
| $C_{14}$ | 7.95 | 0 | 7.95 | 0 |
| $C_{15}$ | 6.63 | 0 | 6.63 | 0 |
| $C_{16}$ | 5.30 | 0 | 5.30 | 0 |
| $C_{17}$ | 3.98 | 0 | 3.98 | 0 |
| $C_{18}$+ | 18.56 | 0 | 18.56 | 0 |
| Mols/Hr | 578.09 | 38.59 | 539.50 | 165.57 |
| Temp. (°F.) | 70 | 70 | 70 | 77 |
| Pressure (psia) | 511 | 511 | 511 | 350 |

TABLE IIB

| Component | First Overhead (230) | First Bottoms (232) | Second Overhead (250) | Second Bottoms (271) | NGL (260) |
|---|---|---|---|---|---|
| Carbon Dioxide | 5.50 | 0 | 0 | 0 | 0 |
| Nitrogen | 0.05 | 0 | 0 | 0 | 0 |
| Methane | 75.64 | 0 | 0 | 0 | 0 |
| Ethane | 36.63 | 3.93 | 5.5 | 0 | 3.93 |
| Propane | 6.31 | 41.75 | 58.45 | 0 | 41.75 |
| i-Butane | 0.97 | 16.01 | 22.41 | 0 | 16.01 |
| n-Butane | 1.13 | 26.67 | 37.34 | 0 | 26.67 |
| i-Pentane | 0.26 | 13.93 | 19.50 | 0 | 13.93 |
| n-Pentane | 0.17 | 12.17 | 17.04 | 0 | 12.17 |
| n-Hexane | 0.19 | 38.90 | 54.46 | 0 | 38.90 |
| $C_7$ | 0.10 | 65.19 | 91.25 | 0 | 65.19 |
| $C_8$ | 0.03 | 54.35 | 75.23 | 0.62 | 53.73 |
| $C_9$ | 0.01 | 36.43 | 32.80 | 13.00 | 23.43 |
| $C_{10}$ | 0 | 23.69 | 3.87 | 20.92 | 2.77 |
| $C_{11}$ | 0 | 15.86 | 0 | 15.83 | 0.03 |
| $C_{12}$ | 0 | 11.93 | 0 | 11.93 | 0 |
| $C_{13}$ | 0 | 9.28 | 0 | 9.28 | 0 |

TABLE IIB-continued

| Component | First Overhead (230) | First Bottoms (232) | Second Overhead (250) | Second Bottoms (271) | NGL (260) |
|---|---|---|---|---|---|
| $C_{14}$ | 0 | 7.95 | 0 | 7.95 | 0 |
| $C_{15}$ | 0 | 6.63 | 0 | 6.63 | 0 |
| $C_{16}$ | 0 | 5.30 | 0 | 5.30 | 0 |
| $C_{17}$ | 0 | 3.98 | 0 | 3.98 | 0 |
| $C_{18}$–$C_{22}$ | 0 | 18.56 | 0 | 18.56 | 0 |
| Mols/Hr | 126.99 | 412.50 | 417.85 | 114.00 | 298.5 |
| Temp. (°F.) | 82 | 410 | 318 | 551 | 116 |
| Pressure (psia) | 67 | 355 | 67 | 72 | 52 |

Each of the embodiments of FIGS. 1 and 2 have the capability of maximizing natural gas liquids or condensate production as may be elected. The designs are such that by simply altering process conditions as much as 20% of stabilized condensate can be separated and treated as natural gas liquids. In addition, the invented process has the capability of increasing the residue gas BTU value by rejecting ethane or propane from the first distillation column.

Production facility alternatives available for processing a high pressure gas condensate produced fluids stream were evaluated, and the results are set forth in Table 3 below.

TABLE 3

COMPARISON OF PROCESS ALTERNATIVES

| | Central Tank Battery (CTB) | CTB with Deethanizer | Invented Process |
|---|---|---|---|
| BBLS/day NGL | 0 | 3,640 | 5,263 |
| BBLS/day Condensate | 19,250 | 19,402 | 19,741 |
| Heat Requirement (MMBTU/hr) | 29.19 | 11.77 | 36.1 |
| Compressor Requirement (HP) | 5,792 | 3,283 | 687 |
| Total Energy Requirement (MMBTU/hr) (assumes 10,000 BTU/bhp-hr) | 87.11 | 44.60 | 42.97 |
| Energy Required/BBL of Condensate Recovered (MBTU/BBL) | 4.53 | 2.30 | 2.18 |
| Energy Required/BBL of Liquid* Recovered (MMBTU/BBL) | 4.53 | 1.94 | 1.72 |

*Liquid = NGL + Condensate

Of special significance are the comparative energy consumption results. Based on Table 3, a CTB (central tank battery) with Deethanizer can reduce energy consumption by 49% and the invented process can reduce energy consumption by 52% per barrel of liquids recovered when compared with a central tank battery facility. When compared on a total liquid recovered basis with a central tank battery facility, the CTB with Deethanizer can reduce energy consumption by 57% and the invented process can reduce energy consumption by 62%. Also, the invented process is indicated to have higher recovery levels of both natural gas liquids and condensate than the other compared processes (5740 bbl/day more than the central tank battery and 1962 bbl/day more than the CTB with Deethanizer for a given specified inlet rate). Also, operating and maintenance costs are expected to be less for the inventive process. Finally, the invented process overcomes operating problems which can be encountered with the CTB with Deethanizer system.

Although the invention has been described as required in terms of preferred embodiments and operating conditions, other changes and modifications in keeping with the invention will be readily apparent to those skilled in the art of produced fluids processing in accordance with the spirit of the invention and within the scope of the claims appended thereto.

What is claimed is:

1. Process comprising producing a residue gas stream and recovering natural gas liquids and stabilized condensate from a produced stream from high pressure gas condensate wells by, introducing the produced fluid stream into a first separator zone operated at about a first pressure, the first pressure being about pipeline pressure for the residue gas stream, and separating the produced fluid stream into a first liquid fraction and a first vapor fraction;

withdrawing the first liquid fraction from the first separator zone and introducing the withdrawn first liquid fraction into a second separator zone at a lower pressure of operation than the first separator zone, and separating the first liquid fraction into a second vapor fraction and a second liquid fraction, the lower pressure of operation being such that the second vapor fraction is compressible by a single stage of compression to about the first pressure;

withdrawing the second liquid fraction from the second separator zone and introducing the withdrawn second liquid fraction as feed into a first distillation column comprising a plurality of vapor-liquid contact devices and operated under conditions effective to produce a first overhead stream enriched in methane, and a first bottoms stream enriched in heavier components of the second liquid fraction, the pressure in the first overhead stream being such that the first overhead stream is compressible by a single stage of compression to about the first pressure;

withdrawing a portion of liquid from adjacent the bottom of the first distillation column, introducing a pressure differential thereinto, and circulating the withdrawn portion by forced circulation through a first reboiler and reintroducing thus reboiled fluid adjacent the bottom of the first distillation column to maintain an effective operating temperature therein;

withdrawing the first bottoms stream from the first distillation column and introducing the withdrawn first bottoms stream as feed into a second distillation column containing a plurality of vapor-liquid contact devices and operated under conditions effective to produce a second overhead stream enriched in natural gas liquid components of the first bottoms stream and a second bottoms stream enriched in heavier components of the first bottoms stream;

withdrawing a portion of liquid from adjacent the bottom of the second distillation column, introducing a pressure differential thereinto, and circulating the withdrawn portion by forced circulation through a second bottoms reboiler and back to adjacent the bottom of the second distillation column to maintain effective operating temperatures in the second distillation column; and compressing the second vapor fraction and the first overhead stream by a single stage of compression to about the first pressure and combining the thus compressed second vapor fraction and the first overhead stream with the first vapor fraction to produce a residue gas stream at pipeline pressure.

2. Process as in claim 1 wherein:

the first bottoms reboiler is a shell-and-tube indirect heat exchanging reboiler and the second bottoms reboiler is a direct-fired reboiler, and comprising:

maintaining the operating temperature in the second distillation column at a temperature in the range between that temperature effective for causing coking in fire tubes of the second bottoms reboiler and that temperature requiring a refrigerated condenser in the overhead of the second distillation column; and withdrawing a portion of the second bottoms stream from the second distillation column and introducing the withdrawn portion as heat exchange medium into the first bottoms reboiler as a source of heat for heating the portion of liquid circulated through the first bottoms reboiler to maintain an effective operating temperature in the first distillation column and to produce a first cooled second bottoms stream portion.

3. Process as in claim 2 further comprising:

withdrawing a portion of intermediate tray liquid from the first distillation column, passing the thus withdrawn portion in indirect heat exchange with at least a portion of the first cooled second bottoms stream to increase the temperature thereof, and reintroducing the thus heated withdrawn portion into the first distillation column and producing a second cooled second bottoms stream; and combining the second cooled second bottoms stream with remaining portion of the first cooled second bottom stream to produce a condensate products stream.

4. Process as in claim 2 wherein:

the second distillation column is operated to produce a second overhead stream enriched in natural gas liquids components and a second bottoms stream enriched in heavy condensate fraction.

5. Process as in claim 2 wherein:

the second distillation column is operated to increase production of a second overhead stream enriched in natural gas liquids components.

6. Process as in claim 1 wherein:

each of the first bottoms reboiler and the second bottoms reboiler are direct-fired reboilers, and comprising:

withdrawing the first bottoms stream from the first distillation column;

withdrawing the second bottoms stream from the second distillation column;

introducing the withdrawn first bottoms stream into indirect heat exchange with the second bottoms stream to produce a heated first bottoms stream and a cooled second bottoms stream; and introducing the heated first bottoms stream as feed into the second distillation column.

7. Process as in claim 6 comprising:

withdrawing a portion of intermediate tray liquid from the first distillation column and passing the withdrawn portion in indirect heat exchange with the second overhead stream to produce a cooled second overhead stream and a heated withdrawn portion reintroduced into the first distillation column.

8. Process as in claim 1, wherein:

the first pressure is in the range of about 300 to about 1200 psia;

the second separator zone is operated at a pressure in the range of about 200 to about 600 psia;

the first column is operated at a pressure in the range of about 100 to about 450 psia and at a temperature in the range of about 0° F. to about 400° F.; and the second column is operated at a pressure in the range of about 50 to about 400 psia and at a temperature below about 550° F.

9. Process as in claim 8 wherein:

the first pressure is in the range of about 600 to about 1200 psia; and the second separator zone is operated at about one-third the pressure of the first separator zone.

* * * * *